United States Patent [19]

Maehara

[11] Patent Number: 4,864,928

[45] Date of Patent: Sep. 12, 1989

[54] PRINTING MACHINE FOR PRINTING CONTINUOUS SLIP

[75] Inventor: Kenso Maehara, Hiroshima, Japan

[73] Assignee: Ryobi Ltd., Japan

[21] Appl. No.: 248,064

[22] Filed: Sep. 23, 1988

[30] Foreign Application Priority Data

Sep. 24, 1987 [JP] Japan ..... 62-240291
Dec. 14, 1987 [JP] Japan ..... 62-316925

[51] Int. Cl.[4] ..... B41F 5/04; B41F 13/02; B41F 13/32

[52] U.S. Cl. ..... 101/218; 101/228; 101/176

[58] Field of Search ..... 101/177, 176, 178, 179–182, 101/184, 185, 219, 220, 225, 228, 247, 217, 218, 138, 139, 143; 226/109, 110, 196

[56] References Cited

U.S. PATENT DOCUMENTS 3,431,843 3/1969 Kaneko et al. ..... 101/218
4,723,488 2/1988 Inouye et al. ..... 101/218

*Primary Examiner*—J. Reed Fisher
*Attorney, Agent, or Firm*—Sughrue, Mion, Zinn, Macpeak & Seas

[57] ABSTRACT

A printing machine for printing a continuous slip includes an angularly-movable lifter shaft disposed below a path of feed of the printing sheet, and a lifter fixedly mounted on the lifter shaft for angular movement therewith toward and away from the underside of the printing sheet. An urging device normally urges the lifter away from the printing sheet. A first tension applying device is operatively connected to the lifter shaft and is operable to angularly move the lifter shaft together with the lifter against the bias of the urging device so as to bring the lifter into engagement with the underside of the printing sheet to apply tension to the printing sheet when impression and blanket cylinders are spaced from each other, thereby preventing a slack developing on the printing sheet. A second tension applying device is operatively connected to the lifter shaft and is operable to angularly move the lifter shaft together with the lifter against the bias of the urging device so as to bring the lifter into engagement with the printing sheet to apply tension when a recess in the impression cylinder is brought into opposed relation to the blanket cylinder, thereby preventing a slack from developing on the printing sheet.

17 Claims, 10 Drawing Sheets

PRINTING MACHINE FOR PRINTING CONTINUOUS SLIP

FIELD OF THE INVENTION

This invention relates generally to printing machines for printing a continuous slip, and more particularly, to such printing machines incorporating a device for applying tension to a printing sheet of paper.

BACKGROUND OF THE INVENTION

Conventionally, the printing of a continuous slip has been carried out by high-speed business form-printing rotary presses.

Such a business form-printing rotary press is quite large in size and requires much time for exchanging printing patterns. Further, during the time when necessary adjustments are made for the pattern exchange, a large loss of the printing sheet is produced. To overcome these difficulties, various handy printing machines or presses have been proposed, particularly for the printing of a small lot of a continuous slip.

Generally, in such continuous slip printing machines, a continuous slip sheet is supplied between a pair of opposed, rotating blanket and impression cylinders, and is intermittently fed so as to effect the printing. Japanese Laid-Open (Kokai) Patent Application No. 62-64552 discloses one such known printing method in which a print sheet is intermittently fed by a pair of tractors disposed respectively on the sheet supply and discharge sides of the impression cylinder and a suction conveyor. Another such conventional method is shown in FIG. 1 in which a pair of tractors b and b, disposed respectively on the sheet supply and discharge sides of an impression cylinder a, feed a printing sheet c so as to effect the printing.

Generally, the conventional printing machines or presses under consideration are so designed that the impression cylinder a is movable relative to a blanket or rubber cylinder d between an operative or printing position where the former is disposed in opposed, contiguous relation to thelatter, and an inoperative or non-printing position, where the former is spaced apart from the latter. With such a construction, when the impression cylinder a is in its inoperative position, the printing sheet c is loosened, and therefore a slack develops on the printing sheet.

Even in the operative position of the impression cylinder a, since the impression cylinder a has a recess or reduced-diameter portion e formed in a peripheral surface thereof, a slack also develops on the printing sheet c when the recess e is brought into opposed relation to the blanket cylinder d.

Therefore, when the printing machine is operated either in the inoperative position, or in the operative position when the impression cylinder a with the recess e is disposed in opposed relation to the blanket cylinder d, the printing sheet c is liable to flatter. As a result, the ink on the blanket cylinder d is transferred to the printing sheet c to produce smudges thereof. The printed sheet with such smudges has no commercial value.

Further, the slack of the printing sheet adversely affects the register (pre-register) of an image relative to the printing sheet and therefore an oblique image is produced.

To overcome the above-mentioned deficiencies of the prior art, there has been proposed a method of eliminating such a slack of the printing sheet. As shown in FIG. 1, in this method, a roll f is provided between the tractor b on the sheet supply side and the impression cylinder a is disposed on an upper side of the printing sheet c. The roll f is brought into contact with the upper side of the printing sheet c under the influence of gravity so as to eliminate the slack of the printing sheet c by the weight of the roll f and associated parts.

With the above slack-eliminating method, however, it is necessary to lock the roll f in its upper inoperative position when the printing sheet c is to be set on the pair of tractors b and b so that the roll f will not interfere with the setting of the printing sheet. This is a rather cumbersome operation. In addition, since the roll f is designed to contact the printing surface of the printing sheet c, the printing surface is liable to be damaged by the roll f, which adversely affects the quality of the printed material. Another disadvantage is that when the printing sheet c is thin, the perforations of the printing sheet fitted on feed pins of the tractor b are liable to be deformed and enlarged by these feed pins if the weight of the roll f and associated parts are too heavy. On the other hand, if such weights are too light, the slack of the printing sheet c cannot be eliminated satisfactorily, particularly where the printing sheet c employed is thick.

SUMMARY OF THE INVENTION

It is therefore an object of this invention to provide a printing machine for printing a slip which is capable of applying a suitable tension to a printing sheet of any thickness to eliminate a slack of the printing sheet without damaging the printing sheet.

According to one aspect of the invention there is provided a printing machine for printing a continuous slip comprising:

(a) a rotatable impression cylinder;

(b) a rotatable blanket cylinder;

(c) means for moving one of the impression and blanket cylinders into and out of an operative position where the two cylinders are disposed in opposed, contiguous relation, the printing sheet being fed between the impression and blanket cylinders;

(d) a pair of tractors disposed respectively on opposite sides of the impression cylinder along a path of feed of the printing sheet so as to feed the printing sheet;

(e) a lifter shaft mounted on a frame for angular movement about an axis thereof, the lifter shaft being disposed between one of the pair of tractors and the impression cylinder and disposed below the path of feed of the printing sheet;

(f) a lifter fixedly mounted on the lifter shaft for angular movement therewith toward and away from the printing sheet;

(g) urging means operatively connected to the lifter shaft for normally urging the lifter away from the printing sheet; and (h) first tension applying means operatively connected to the lifter shaft and operable to angularly move the lifter shaft together with the lifter against the bias of the urging means so as to bring the lifter into engagement with the printing sheet to apply tension to the printing sheet when the one cylinder is out of its operative position.

With this construction, when for example, the impression cylinder is out of its operative position relative to the blanket cylinder, a suitable tension is applied by the angularly-movable lifter to the printing sheet, so that no slack develops on the printing sheet. Therefore, the generation of ink smudges as well as an oblique image resulting from such slack is positively prevented, and the precision of the register of the image can be improved. In addition, since the lifter shaft is disposed below the printing sheet so that the lifter is engageable with the underside of the printing sheet, then the printing surface (i.e., the top surface of the printing sheet) is not damaged by the lifter. Further, this construction also facilitates the setting of the printing sheet on the tractors since the lifter will not interfere with such setting.

According to another aspect of the invention, there is provided a printing machine having a second tension applying means which is operatively connected to the lifter shaft and operable to angularly move the lifter shaft together with the lifter against the bias of the urging means so as to bring the lifter into engagement with the printing sheet to apply tension when the recess contained in the impression cylinder is brought into opposed relation to the blanket cylinder. Thus, a suitable tension is also applied to the printing sheet when the recess which is contained in the periphery of the impression cylinder is brought into opposed relation to the blanket cylinder.

DESCRIPTION OF THE PREFERRED EMBODIMENTS OF THE INVENTION

Figure 1:
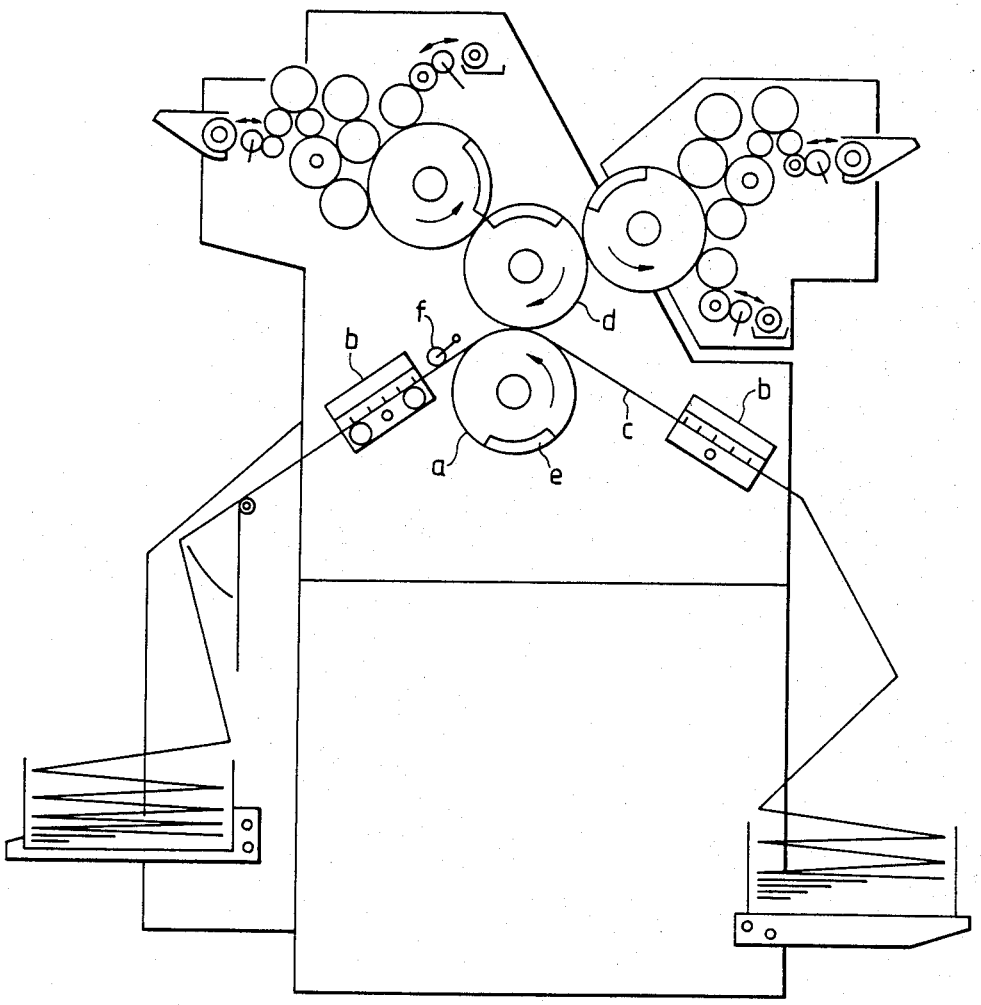
FIG. 1 (PRIOR ART)
FIG. 1 is a view similar to FIG. 5 but showing a conventional printing machine.
Figure 2:
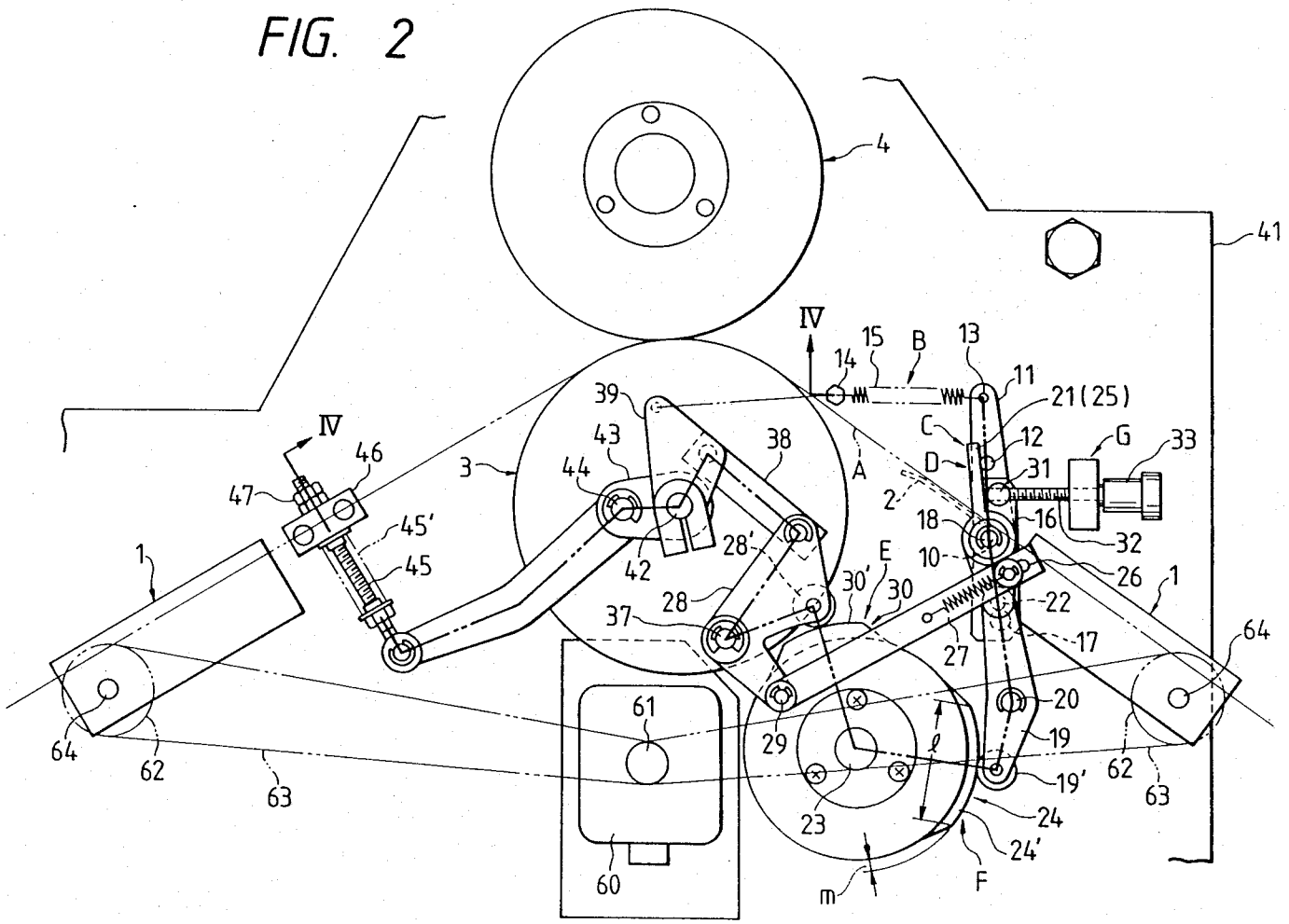
FIG. 2 is a side-elevational view of a main portion of a printing machine of a first embodiment of the present invention, as viewed from the side opposite to the operation side.

A first embodiment of the invention will now be described with reference to FIGS. 2–8. A printing machine for printing a continuous slip comprises a device for applying tension to a printing sheet A. This tension-applying device comprises a pair of tractors 1 and 1 provided respectively on opposite sides of an impression cylinder 3 along a path of feed of the printing sheet A so as to feed printing sheet A in a well known manner, a lifter shaft having a plate-like, elongated lifter 2 fixedly mounted thereon at one lateral end or side, spring-loaded urging means B for normally urging a free end of the lifter 2, remote from the lifter shaft 10, away from the underside of the printing sheet A, first arm means C, second arm means D, first tension applying means E, second tension applying means F, and tension adjusting means G.

The lifter shaft 10 is mounted on opposed side walls 40 and 41 of a frame for rotation or angular movement about an axis thereof and is disposed between the impression cylinder 3 and one of the tractors 1, the lifter shaft 10 being disposed below the path of feed of the printing sheet A. As later described, upon rotation or angular movement of the lifter shaft 10, the lifter 2 is brought into engagement with the underside of the printing sheet A to apply tension to the printing sheet A.

The spring-loaded urging means B comprises an arm 11 fixedly secured at one end thereof to one end of the lifter shaft 10, and a tension spring 15 extending between a pin 13 on the other end of the arm 11 and a pin 14 fixedly secured to the frame wall 41 so as to urge the lifter shaft 10 to angularly move in a counterclockwise direction (FIG. 2) through the arm 11, thereby normally keeping the free end of the lifter 2 away from the underside of the printing sheet A.

The first arm means C comprises a first arm 21 pivotally mounted by a pivot pin 18 to an arm bracket 16 which in turn is pivotally connected to the frame wall 41 by a stud 17. As later described, the pivotal arm bracket 16 is held against movement by the tension adjusting means G. The first arm 21 is engaged with a pin 12, fixedly secured to the arm 11 of the spring-loaded urging means B, under the bias of the urging means B to limit the movement of the lifter 2 away from the print sheet A.

The second arm means D comprises a second arm 25 pivotally connected to the arm bracket 16 by the above-mentioned pivot pin 18, the second arm 25 being engaged with the aforesaid pin 12 on the arm 11 under the bias of the spring-loaded urging means B to limit the movement of the lifter away from the lifter 2.

The first tension applying means E comprises an operating cam 30 fixedly mounted on a cam shaft 23 rotatably mounted on the frame walls 40 and 41, a cam lever 28 pivotally mounted on the frame wall 41 by a stud 37, and a link 27 pivotally connected at one end to the cam lever 28 by a pin 29 and connected at the other end to one end of the second arm 25 of the second arm means D by a pin 26. The cam lever 28 has a cam follower 28 rotatably mounted thereon and held in contact with the outer periphery of the operating cam 30 which serves as a cam surface. A mechanism H (FIG. 3) is provided for bringing the impression cylinder 3 into and out of its operative position relative to the blanket cylinder 4. The cam lever 28 is pivotally moved about the stud 37 in accordance with the operation of the mechanism H. The cam lever 28 is pivotally moved by the operating cam 30 through the cam follower 28' and is held in contact with the outer periphery of the operating cam 30. The cam shaft 23 is rotated together with the operating cam 30 in synchronism with the rotation of the impression cylinder 3. In the operative position of the impression cylinder 3 where the impression cylinder 3 is spaced apart from the blanket cylinder 4, the cam follower 28' is held in contact with the lower portion of the periphery of the operating cam 30 other than a raised portion 30'. When the cam follower 28' is brought into contact with this lower portion of the operating cam 30, the cam lever 28 is angularly moved about the stud 37 to angularly move the arm 11 and the lifter shaft 10 in a clockwise direction (FIG. 2) through the link 27 and the second arm means D, thereby angularly moving the lifter 2 to a predetermined position, that is, into engagement with the underside of the printing sheet A so as to apply tension to it. In the operative position of the impression cylinder 3 where the impression cylinder 3 is disposed in opposed, contiguous relation to the blanket cylinder 4, the cam follower 28′ is in contact with the raised portion 30′ of the periphery of the operating cam 30. When the cam follower 28′ is brought into contact with this raised portion 30′, the second arm 25 is angularly moved in a direction opposite to the above-mentioned direction to angularly move the lifter shaft 10 together with the lifter 2 in the counterclockwise direction (FIG. 2), so that the lifter 2 is moved away from the underside of the printing sheet A, thereby releasing the tension applied thereto.

The second tension applying means F comprises a cam 24 fixedly mounted on the cam shaft 23, and an arm 19 pivotally mounted on the frame wall 41 by a stud 20. Rotatably mounted to one end of the arm 19 is a cam follower 19′ which is held in contact with the outer periphery of the cam 24. A pin 22, fixedly secured to one end of the first arm 21 of the first arm means C, is received in a slot 19″ (see FIG. 4) formed through the other end of the arm 19. The arm 19 is pivotally moved about the stud 20 by virtue of a radial distance m between a raised portion 24′ of the outer periphery of the cam 24 and a lower portion thereof other than the raised portion 24′, the outer periphery of the cam 24 serving as a cam surface. More specifically, when the cam follower 19′ is brought into contact with the raised portion 24′ of the cam 24, the arm 19 is pivotally moved about the stud 20 in a counterclockwise direction (FIG. 2) to angularly move the arm 11 and the lifter shaft 10 in a clockwise direction (FIG. 2) through the first arm means C against the bias of the tension spring 15 of the spring loaded urging means B, thereby angularly moving the lifter 2 to a predetermined position, that is, into engagement with the underside of the printing sheet A so as to apply tension thereto. When the cam follower 19′ is held in contact with the lower portion of the periphery of the cam 24, such tension is not applied to the printing sheet A. A circumferential length 1 of the raised portion 24′ of the cam 24 is so determined that only when the printing sheet A faces the recess 3′ of the impression cylinder 3, the lifter 2 applies the tension to the printing sheet A.

The tension adjusting means G comprises a set screw 32 mounted on the frame wall 41 through a mounting member 32′ (see FIG. 9) so as to be rotatable about an axis thereof, the set screw 32 having a thumb piece 33 at one end and being threaded into a threaded hole 31′ formed through a pin 31 fixedly secured to the arm bracket 16. The pivotal arm bracket 16 is held against movement by the set screw 32. With this arrangement, the rotation of the set screw 32 causes the arm bracket 16 to angularly move about the stud 17 so as to change the position of each of the first and second arms 21 and 25 held in engagement with the pin 12, so that the position of the lifter shaft 10 is correspondingly changed through the arm 11. As a result, the upper limit of the angular movement of the lifter 2 is changed, thereby adjusting the tension to be applied to the printing sheet A by the lifter 2.

Figure 3:
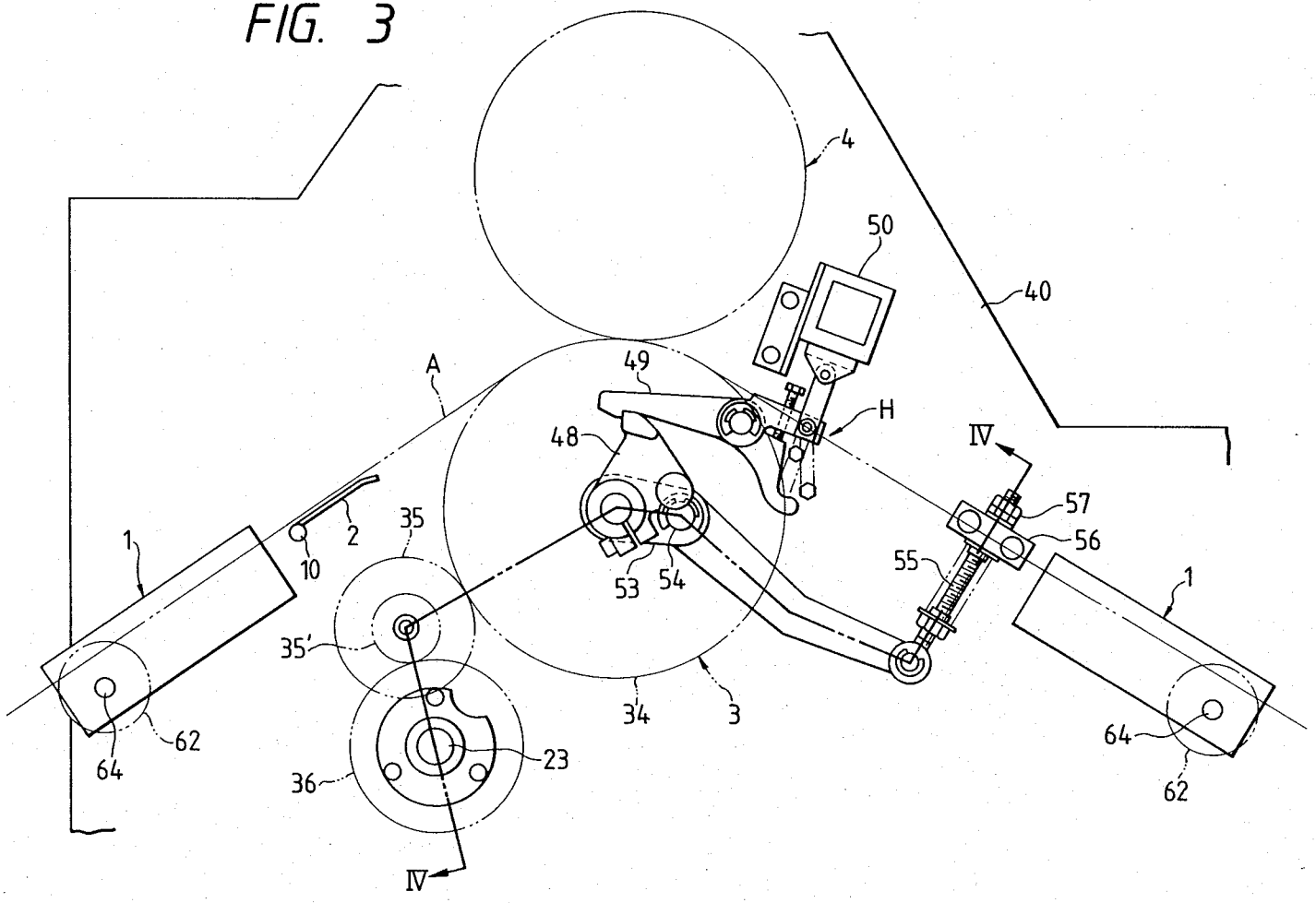
FIG. 3 is a side-elevational view of the main portion as viewed from the operating side.
Figure 4:
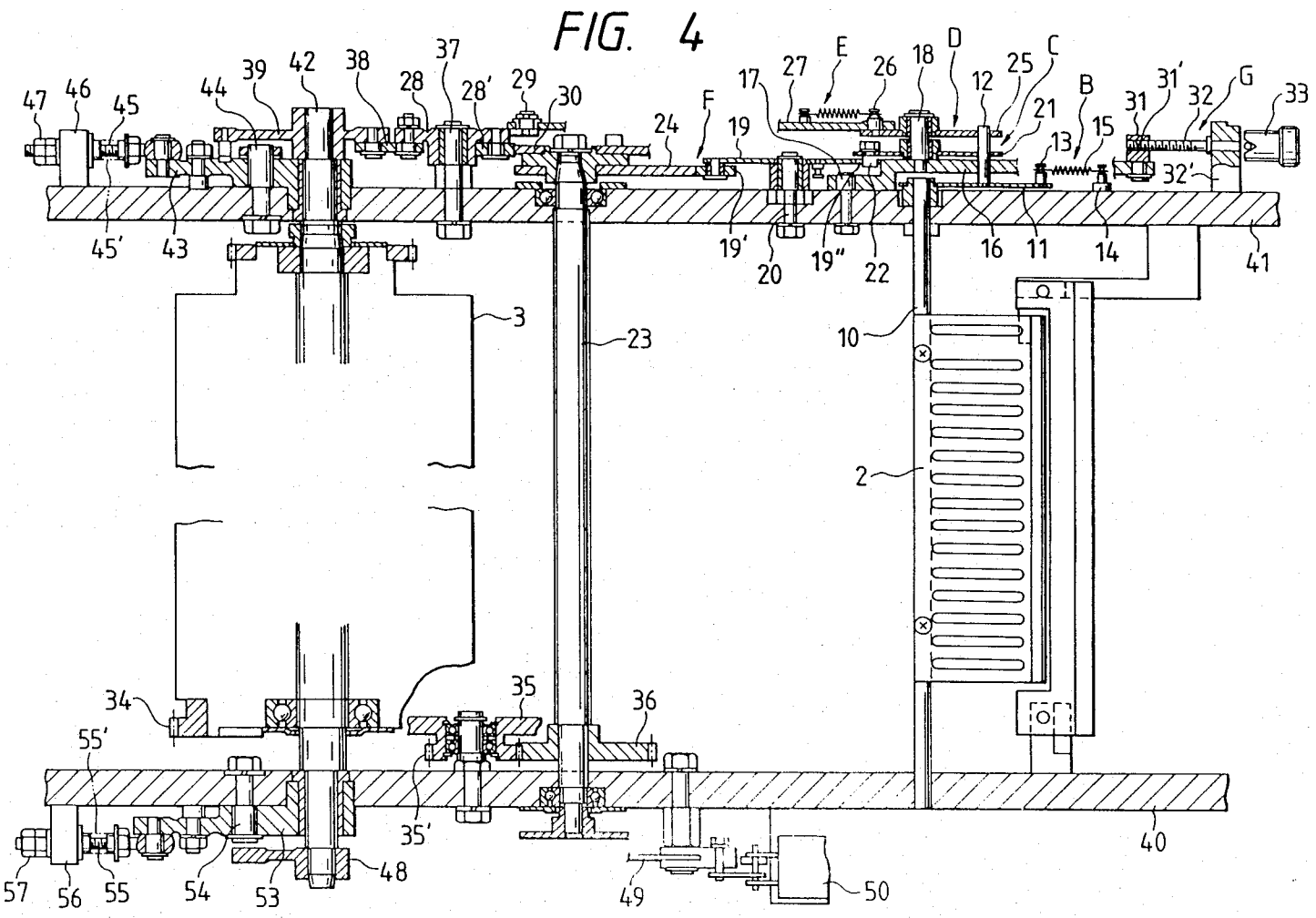
FIG. 4 is a cross-sectional view taken along the line III—III of FIGS. 2 and 3.

The operating cam 30 and the cam 24 are rotated in synchronism with the rotation of the impression cylinder 3 through an impression cylinder gear 34, idle gears 35 and 35′ and a gear 36 fixedly mounted on the cam shaft 23 (see FIG. 3).

The above-mentioned mechanism H for moving the impression cylinder 3 into and out of its operative position relative to the blanket cylinder 4 is of the type disclosed in Japanese Laid-Open (Kokai) Utility Model Application No. 50-26902 or may be of any other known type. The mechanism H will now be described. When the cam follower 28′ is brought into contact with the raised portion 30′ of the operating cam 30, the cam lever 28 is angularly moved about the stud 37 in a counterclockwise direction (FIG. 2), so that the impression cylinder 3 is moved into its operative position relative to the blanket cylinder 4 through a link 38 and an arm 39 fixedly mounted on a shaft 42 of the impression cylinder 3. Upon movement of the impression cylinder 3 into its operative position, the impression cylinder 3 is maintained in its operation position by means of a lever 48, and a latch 49, and a solenoid 50 (FIG. 3). In this condition, the printing sheet A is fed, and the lifter 2 is brought into engagement with the underside of the printing sheet A to apply the tension thereto only when the printing sheet A faces the recess 3′ in the periphery of the impression cylinder 3.

The impression cylinder 3 is resiliently supported by a pair of arms 43 and 53 mounted respectively on the frame walls 41 and 40 by studs 44 and 54, a pair of screws 45 and 55, a pair of coil springs 45′ and 55′ wound around the screws 45 and 55, respectively, a pair of blocks 46 and 56 and a pair of nuts 47 and 57.

The feeding of the printing sheet A by the tractors 1 and 1 will now be described. A timing pulley 61 is rotated by an amount determined by a servomotor 60 to rotate timing pulleys 62 and 62 through a timing belt 63, so that spline shafts 64 and 64 on which the timing pulleys 62 and 62 are fixedly mounted, respectively, are rotated to drive the tractors 1 and 1. As a result, the printing sheet A is fed through the engagement of fed pins (not shown) of the tractors in perforations in the printing sheet A.

Figure 6:
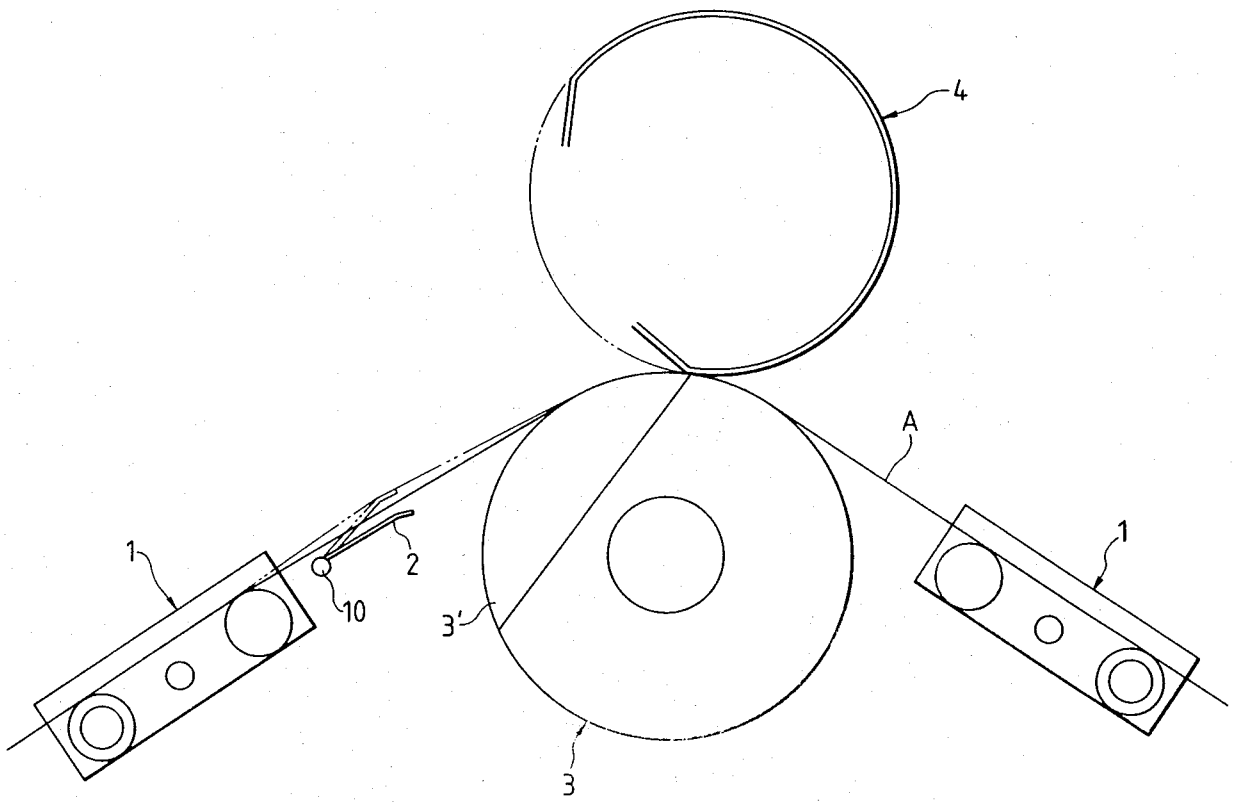
FIG. 6 is a side-elevational view of a portion of the printing machine, showing the condition of impression and blanker cylinders at the time when the printing is started.

FIG. 6 shows the condition of the impression and blankets cylinders 3 and 4, respectively, at the time when the printing is started. The printing sheet A is fed or moved as indicated by a solid line.

Figure 7:
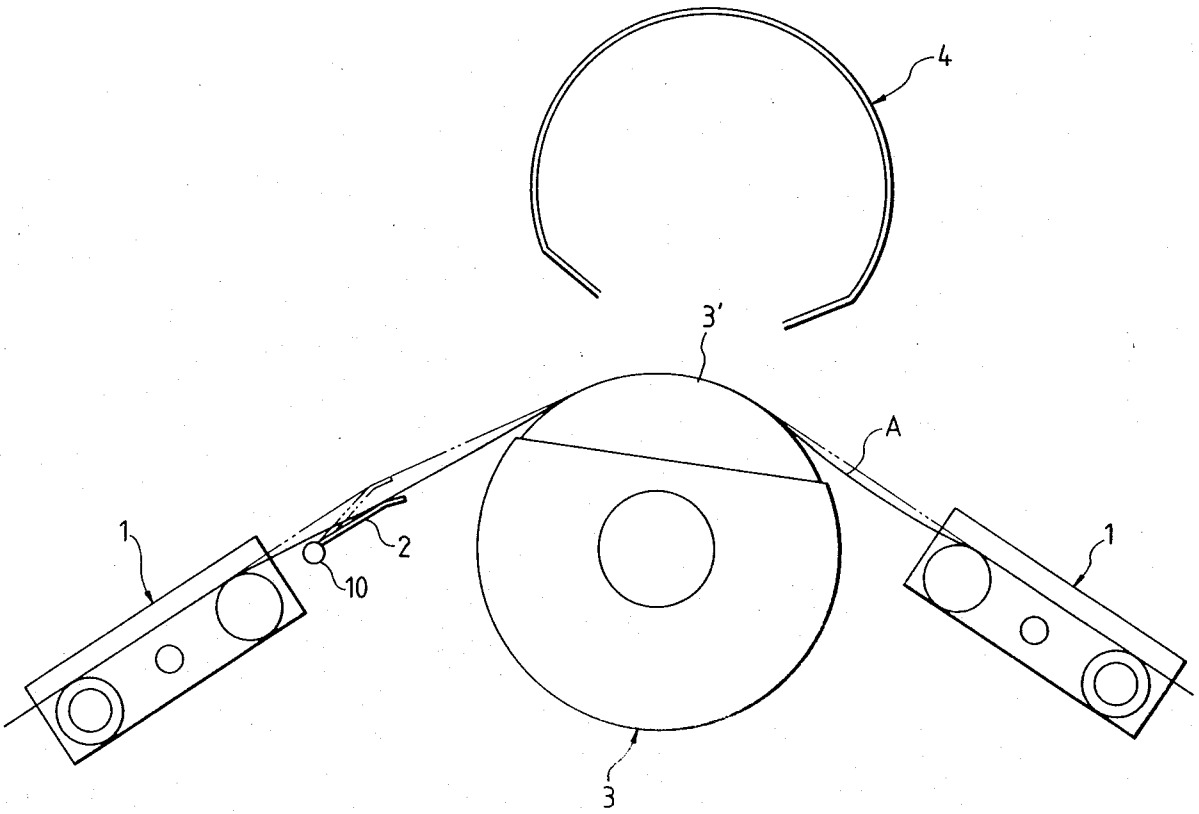
FIG. 7 is a view similar to FIG. 6 but showing a condition prior to the printing operation.

FIG. 7 shows the condition of the impression and blanket cylinders 3 and 4 before the printing is started. The recess 3′ of the impression cylinder 3 is directed upwardly, that is, disposed in opposed relation to the blanket cylinder 4. In this condition, since the diameter of the recess 3′ is smaller than that of the impression cylinder 3, a slack develops on the printing sheet A, and therefore, the lifter 2 is moved upwardly into engagement with the underside of the printing sheet A to apply a suitable tension to it as indicated in a dash-and-dots line, thereby eliminating such slack, as described above.

Figure 8:
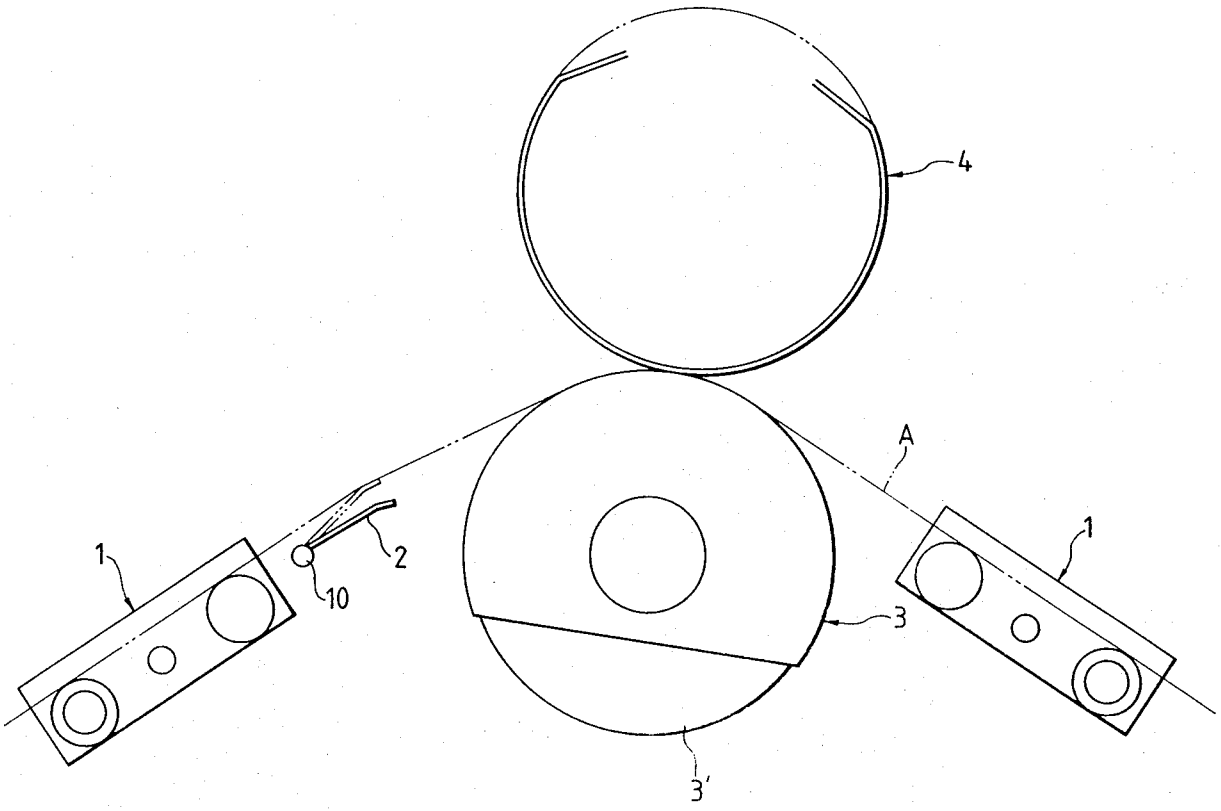
FIG. 8 is a view similar to FIG. 6 but showing the impression cylinder in its inoperative position.

FIG. 8 shows in inoperative condition of the impression cylinder 3 in which the impression cylinder 3 is spaced apart from the blanket cylinder 4. In this case, the slack of the printing sheet A also develops as is the case with the condition shown in FIG. 7. Therefore, to eliminate such slack, the lifter 2 is moved upwardly into engagement with the underside of the printing sheet A to apply a suitable tension thereto, as indicated in the dash-and-dot line in FIG. 7.

Figure 5:
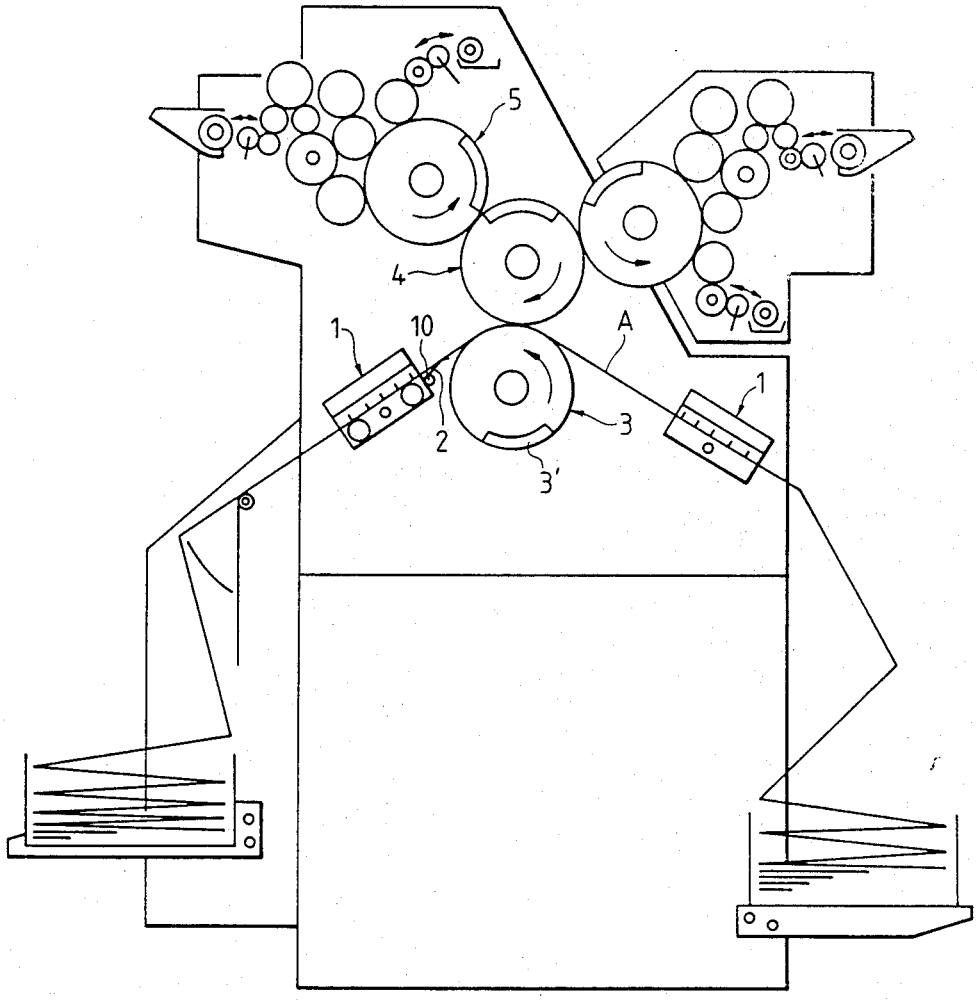
FIG. 5 is a schematic side-elevational view of the overall construction of the printing machine.

Referring to FIG. 5, a reference numeral 5 denotes a plate cylinder.

Figure 9:
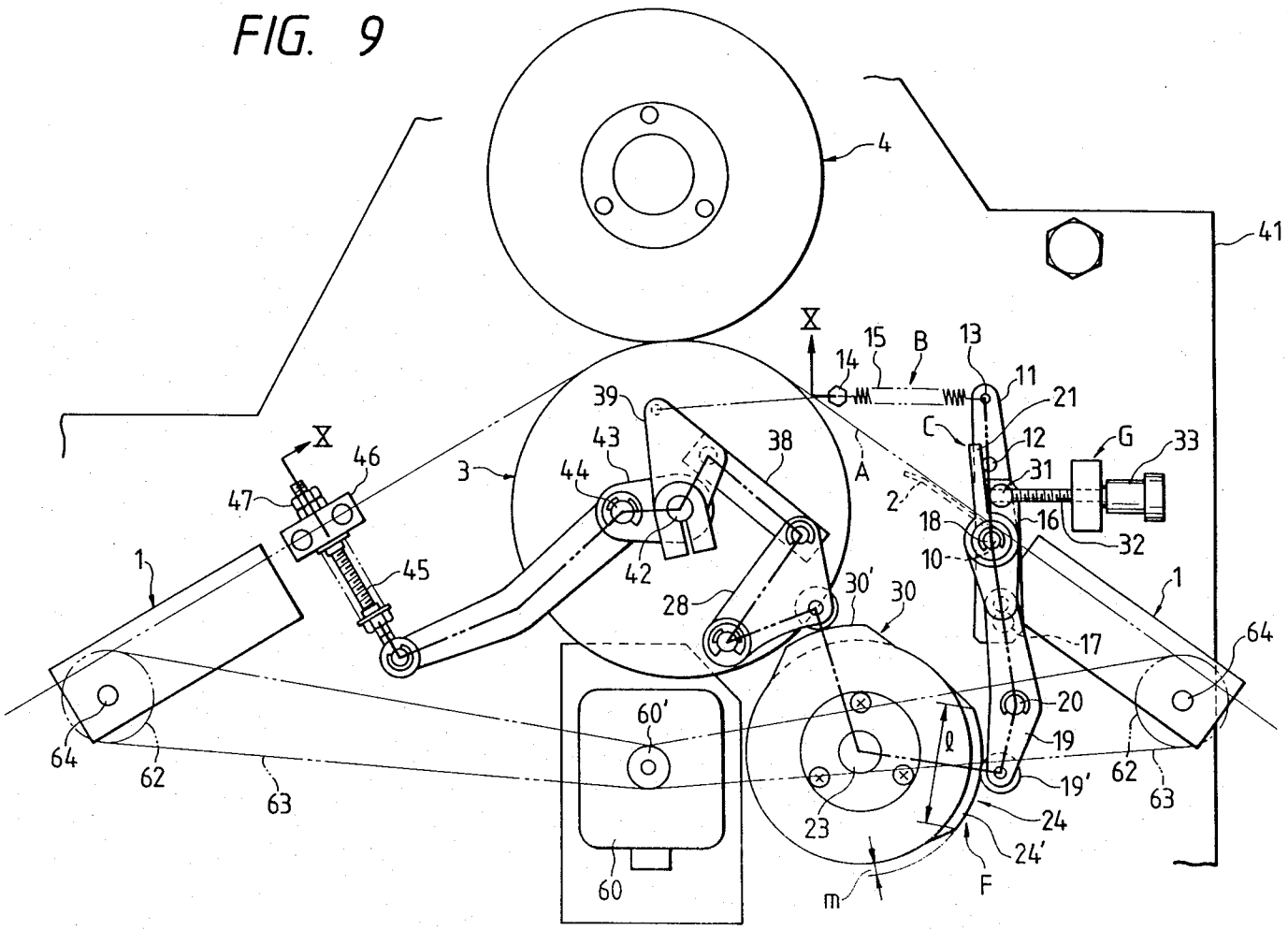
FIG. 9 is a view similar to FIG. 2 but showing a modified form of the invention.
Figure 10:
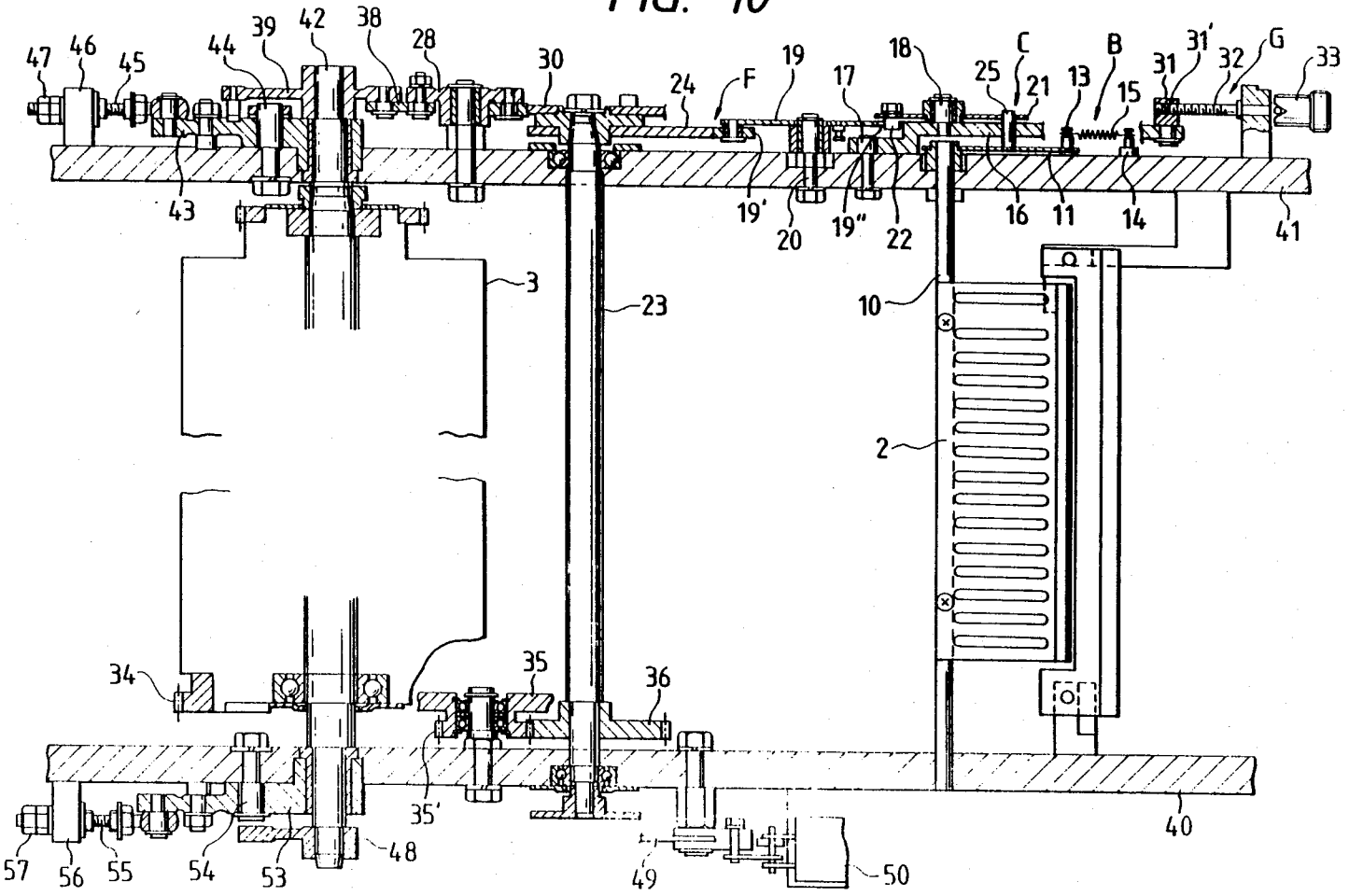
FIG. 10 is a view similar to FIG. 4 but showing the modified form of the invention.

FIGS. 9 and 10 show a second embodiment of the invention which differs from the first embodiment shown in FIGS. 2 to 8 in that there are omitted the first tension applying means E and the second arm means D which cooperate with each other to eliminate a slack of the printing sheet A when the impression cylinder 3 is spaced apart from the blanket cylinder 4. In the second embodiment of the invention, however, the operating cam 30 is provided for moving the impression cylinder 3 into and out of its operative position relative to the blanket cylinder 4.

While the printing machines according to the present invention have been specifically shown and described herein, the invention itself is not to be restricted to the exact showing of the drawings or the description thereof. For example, although in the illustrated embodiments, the impression cylinder 3 is designed to be moved relative to the blanket cylinder 4, the printing machines may be modified in such a manner that the blanket cylinder 4 is movable relative to the impression cylinder 3.

Also, the printing machine of the first embodiment can be so modified that the second tension applying means F is omitted. Such modification is applicable to a printing machine in which the impression cylinder 3 is not provided with the recess 3' in its peripheral surface.

What is claimed is:

1. A printing machine for printing a continuous slip comprising:

(a) a rotatable impression cylinder;

(b) a rotatable blanket cylinder;

(c) means for moving said impression cylinder with respect to said blanket cylinder into and out of an operative position where said two cylinders are disposed in opposed, contiguous relation, a printing sheet being fed between said impression and blanket cylinders;

(d) a pair of tractors disposed respectively on opposite sides of said impression cylinder along a path of feed of the printing sheet so as to feed the printing sheet;

(e) a lifter shaft rotatably mounted on a frame, said lifter shaft being disposed between one of said pair of tractors and said impression cylinder and disposed below the path of feed of the printing sheet;

(f) a lifter fixedly mounted on said lifter shaft for angular movement therewith toward the underside of the printing sheet for urging the underside and away from the underside;

(g) urging means operatively connected to said lifter shaft for normally urging said lifter away from the underside of the printing sheet; and (h) first tension applying means operatively connected to said lifter shaft in such a manner that said lifter shaft rotatably moves together with said lifter against the bias of the urging means so as to urge the underside of the printing sheet to apply tension to the printing sheet when said impression cylinder is out of its operative position.

2. A printing machine for printing a continuous slip comprising:

(a) a rotatable impression cylinder having a recess formed in an outer periphery thereof;

(b) a rotatable blanket cylinder, one of the impression and blanket cylinders being movable into and out of an operative position where said two cylinders are disposed in opposed, contiguous relation, a printing sheet being fed between said impression and blanket cylinders;

(c) a pair of tractors disposed respectively on opposite sides of said impression cylinder along a path of feed of the printing sheet so as to feed the printing sheet;

(d) a lifter shaft fixedly mounted on a frame, said lifter shaft being disposed between one of said pair of tractors and said impression cylinder;

(e) a lifter fixedly mounted on said lifter shaft for angular movement therewith toward the underside of the printing sheet for urging the underside and away from the underside;

(f) urging means operatively connected to said lifter shaft for normally urging said lifter away from the underside of the printing sheet; and (g) tension applying means connected to said lifter shaft in such a manner that said lifter shaft rotatably moves together with said lifter against the bias of said urging means so as to urge the underside of the printing sheet to apply tension when said recess in said impression cylinder is rotated at a position facing said blanket cylinder.

3. A printing machine for printing a continuous slip comprising:

(a) a rotatable impression cylinder having a recess formed in an outer periphery cylinder;

(b) a rotatable blanket cylinder;

(c) means for moving said impression cylinder with respect to blanket cylinder into and out of an operative position where said two cylinders are disposed in opposed, contiguous relation, a printing sheet being fed between said impression and blanket cylinders;

(d) a pair of tractors disposed respectively on opposite side of said impression cylinder along a path of feed of the printing sheet so as to feed the printing sheet;

(e) a lifter shaft rotatably mounted on a frame, said lifter shaft being disposed between one of said pair of tractors and said impression cylinder and disposed below the path of feed of the printing sheet;

(f) a lifter fixedly mounted on said lifter shaft for rotation therewith toward the underside of the printing sheet for urging the underside and away from the underside;

(g) urging means operatively connected to said lifter shaft for normally urging said lifter away from the underside of the printing sheet;

(h) first tension applying means operatively connected to said lifter shaft in such a manner that said lifter shaft rotatably moves together with said lifter against the bias of the urging means so as to urge the underside of the printing sheet to apply tension to the printing sheet when said impression cylinder is out of its operative position; and (i) second tension applying means connected to said lifter shaft in such a manner that said lifter shaft rotatably moves together with said lifter against the bias of said urging means so as to urge the underside of the printing sheet to apply tension when said recess in said impression cylinder is rotated at a position facing said blanket cylinder.

4. A printing machine according to claim 1, in which said lifter is in the shape of a square plate and is fixedly secured at one end to said lifter shaft, so that an opposite end of the lifter remote from said one end is engageable with the printing sheet.

5. A printing machine according to claim 2, in which said lifter is in the shape of a square plate and is fixedly secured at one end to said lifter shaft, so that an opposite end of the lifter remote from said one end is engageable with the printing sheet.

6. A printing machine according to claim 3, in which said lifter is in the shape of a square plate and is fixedly secured at one end to said lifter shaft, so that an opposite end of the lifter remote from one end is engageable with the printing sheet.

7. A printing machine according to claim 1, further comprising:

an arm fixedly secured to said lifter shaft, said arm having a pin secured thereto; and a first arm pivotally mounted with respect to the frame, said first arm being engaged with said pin under the bias of said urging means to limit the movement of said lifter away from the printing sheet; and wherein said first tension applying means comprises a first cam rotatable in synchronism with the rotation of said impression cylinder, and a first cam follower in contact with a peripheral cam surface of said first cam, and said first cam follower is connected to said first arm so as to rotate said lifter toward the underside of the printing sheet for urging the underside through said pin, said arm fixedly secured to said lifter shaft and said lifter shaft when said impression cylinder is out of its operative position.

8. A printing machine according to claim 2, further comprising:

an arm fixedly secured to said lifter shaft, said arm having a pin secured thereto; and a first arm pivotally mounted with respect to the frame, said first arm being engaged with said pin under the bias of said urging means to limit the movement of said lifter away from the printing sheet; and wherein said tension applying means comprises a cam rotatable in synchronism with the rotation of said impression cylinder, and a cam follower in contact with a peripheral cam surface of said cam, and said cam follower is connected to said first arm so as to rotate said lifter toward the underside of the printing sheet for urging the underside through said pin, said arm fixedly secured to said lifter shaft and said lifter shaft when said recess in said impression cylinder is rotated at a position facing said blanket cylinder.

9. A printing machine according to claim 3, further comprising:

a arm fixedly secured to said lifter shaft, said arm having a pin secured thereto;

a first arm being pivotally mounted with respect to the frame, said first arm being engaged with said pin under the bias of said urging means to limit the movement of said lifter away from the printing sheet, said first tension applying means comprising a first cam rotatable in synchronism with the rotation of said impression cylinder and a first cam follower in contact with a peripheral cam surface of said first cam, said first cam follower being engaged with said first arm so as to move said lifter toward the printing sheet through said pin, said arm fixedly secured to said lifter shaft and said lifter shaft when said impression cylinder is out of its operative position; and a second arm being pivotally mounted with respect to the frame, said second arm being engaged with said pin under the bias of said urging means to limit the movement of said lifter away from the printing sheet; and wherein said second tension applying means comprises a second cam rotatable in synchronism with the rotation of said impression cylinder, and a second cam follower in contact with a peripheral cam surface of said second cam, said second cam follower being engaged with said second arm so as to move said lifter toward the underside of the printing sheet through said pin, and said arm fixedly secured to said lifter shaft and said lifter shaft when the recess in said impression cylinder is brought into opposed relation to said blanket cylinder.

10. A printing machine according to claim 8, in which said cam surface of said cam has a raised portion of a predetermined circumferential length, said tension applying means applying the tension to the printing sheet while said cam follower is in contact with said raised portion.

11. A printing machine according to claim 9, in which said cam surface of said second cam has a raised portion of a predetermined circumferential length, said second tension applying means applying the tension to the printing sheet while said second cam follower is in contact with said raised portion.

12. A printing machine according to claim 1, further comprising tension adjusting means for adjusting the tension applied to the printing sheet by said lifter.

13. A printing machine according to claim 2, further comprising tension adjusting means for adjusting the tension applied to the printing sheet by said lifter.

14. A printing machine according to claim 3, further comprising tension adjusting means for adjusting the tension applied to the printing sheet by said lifter.

15. A printing machine according to claim 7, further comprising tension adjusting means for adjusting the tension applied to the printing sheet by said lifter, said tension adjusting means comprising an arm bracket pivotally mounted on the frame, and a set screw mounted on the frame for rotation about an axis thereof, said set screw being threadedly engaged with said arm bracket and holding said arm bracket against movement, the rotation of said set screw pivotally moving said arm bracket.

16. A printing machine according to claim 8, further comprising tension adjusting means for adjusting the tension applied to the printing sheet by said lifter, said tension adjusting means comprising an arm bracket pivotally mounted on the frame, and a set screw mounted on the frame for rotation about an axis thereof, said set screw being threadedly engaged with said arm bracket and holding said arm bracket against movement, the rotation of said set screw pivotally moving said arm bracket.

17. A printing machine according to claim 9, further comprising tension adjusting means for adjusting the tension applied to the printing sheet by said lifter, said tension adjusting means comprising an arm bracket pivotally mounted on the frame, and a set screw mounted on the frame for rotation about an axis thereof, said set screw being threadedly engaged with said arm bracket and holding said arm bracket against movement, the rotation of said set screw pivotally moving said arm bracket.

* * * * *